US006778087B2

(12) United States Patent
Belka et al.

(10) Patent No.: US 6,778,087 B2
(45) Date of Patent: Aug. 17, 2004

(54) DUAL AXIS MAGNETIC FIELD EAS DEVICE

(75) Inventors: Anthony M. Belka, Stillwater, MN (US); Ronald D. Jesme, Plymouth, MN (US); Peter J. Zarembo, Shoreview, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 232 days.

(21) Appl. No.: 09/882,790

(22) Filed: Jun. 15, 2001

(65) Prior Publication Data

US 2003/0001740 A1 Jan. 2, 2003

(51) Int. Cl.[7] ..... G08B 13/14

(52) U.S. Cl. ..... 340/572.3; 340/572.7; 340/572.8; 335/284

(58) Field of Search ..... 340/572.3, 572.1, 340/572.6, 572.7, 572.8, 572.9; 335/284

(56) References Cited

U.S. PATENT DOCUMENTS

| | | | | | |
|---|---|---|---|---|---|
| 3,765,007 | A | | 10/1973 | Elder | 340/572.3 |
| 4,575,624 | A | | 3/1986 | Klinkhardt | 235/449 |
| 4,665,387 | A | | 5/1987 | Cooper et al. | 340/572.3 |
| 4,673,923 | A | | 6/1987 | Boscoe et al. | 340/572.3 |
| 4,906,974 | A | | 3/1990 | Rehder | 340/551 |
| 5,059,951 | A | | 10/1991 | Kaltner | 340/572.3 |
| 5,126,720 | A | * | 6/1992 | Zhou et al. | 335/284 |
| 5,257,010 | A | | 10/1993 | Rehder | 340/572.3 |
| 5,285,182 | A | | 2/1994 | Zarembo | 335/284 |
| 5,315,096 | A | | 5/1994 | Müller et al. | 235/462.13 |
| 5,473,584 | A | * | 12/1995 | Oshima | 369/47.11 |
| 5,477,202 | A | | 12/1995 | Zarembo et al. | 335/284 |
| 5,534,836 | A | | 7/1996 | Schenkel et al. | 335/284 |
| 5,614,938 | A | | 3/1997 | Sugiyama et al. | 347/247 |
| 5,625,339 | A | | 4/1997 | Zarembo et al. | 340/551 |
| 5,699,047 | A | * | 12/1997 | Tsai et al. | 340/572.6 |
| 5,705,986 | A | | 1/1998 | Zschirnt | 340/572.3 |
| 5,777,884 | A | | 7/1998 | Belka et al. | 700/225 |
| 5,781,111 | A | * | 7/1998 | Easter et al. | 340/572.3 |
| 5,818,336 | A | | 10/1998 | Varga et al. | 340/545.1 |
| 5,825,292 | A | | 10/1998 | Tsai et al. | 340/572.6 |
| 5,867,101 | A | | 2/1999 | Copeland et al. | 340/572.3 |
| 5,917,412 | A | * | 6/1999 | Martin | 340/572.3 |
| 5,990,794 | A | | 11/1999 | Alicot et al. | 340/573.1 |
| 6,002,335 | A | | 12/1999 | Zarembo et al. | 340/572.1 |
| 6,011,474 | A | | 1/2000 | Coffey et al. | 340/572.3 |
| 6,111,507 | A | | 8/2000 | Alicot et al. | 340/572.1 |
| 6,169,483 | B1 | * | 1/2001 | Ghaffari et al. | 340/572.3 |
| 6,195,007 | B1 | | 2/2001 | Takayama et al. | 340/572.1 |
| 6,201,474 | B1 | | 3/2001 | Brady et al. | 340/572.8 |
| 6,232,870 | B1 | | 5/2001 | Garber et al. | 340/10.1 |

FOREIGN PATENT DOCUMENTS

| | | | |
|---|---|---|---|
| EP | 0 287 905 A1 | 10/1991 | G08B/13/24 |
| EP | 0 454 021 A1 | 10/1991 | G08B/13/24 |
| EP | 0 499 582 A1 | 8/1992 | G08B/13/24 |
| EP | 0 703 552 A1 | 3/1996 | G08B/13/24 |
| EP | 0 715 284 A2 | 6/1996 | G08B/13/24 |
| EP | 1 049 115 A1 | 11/2000 | H01F/13/00 |
| WO | WO 95/08177 | 3/1995 | H01F/7/20 |
| WO | WO 98/13805 | 4/1998 | G08B/23/00 |

* cited by examiner

*Primary Examiner*—Benjamin C. Lee
(74) *Attorney, Agent, or Firm*—Melissa E. Buss

(57) ABSTRACT

A device is disclosed for activating and deactivating magnetic electronic article surveillance (EAS) markers. In one embodiment, the device includes control circuitry comprising a coil, such as a solenoid-type coil, that provides a magnetic field in one direction and another coil that provides a magnetic field in a substantially perpendicular direction, so that EAS markers that pass through the device are positioned generally in the plane defined by the first and second directions.

16 Claims, 4 Drawing Sheets

DUAL AXIS MAGNETIC FIELD EAS DEVICE

INCORPORATION BY REFERENCE

The entire contents of commonly assigned U.S. patent application Ser. No. 09/611,248, filed Jul. 7, 2000, and entitled "Device for Changing the Status of Dual Status Magnetic Electronic Article Surveillance Markers" is hereby incorporated by reference herein.

TECHNICAL FIELD

The present invention relates to a device for changing the status of a dual status magnetic electronic article surveillance marker.

BACKGROUND OF THE INVENTION

Magnetic electronic article surveillance ("EAS") markers have been used for many years to protect items of value against theft. These EAS markers typically have a signal-producing layer made of a low coercive force, high permeability magnetic material, and a continuous or segmented signal-blocking layer made of a permanently magnetizable magnetic material. When the signal-blocking layer is activated, it effectively prevents the signal-producing layer from providing a signal that is detectable by an EAS detection system, and thus the EAS marker is deactivated. When the signal-blocking layer is deactivated, then the EAS marker is activated, and an EAS detection system is able to detect the marker. EAS markers that may be activated and deactivated as described are sometimes referred to as "dual-status" markers, to distinguish them from "single-status" markers that are always activated. Billions of dual-status EAS markers have been sold to date, and they protect assets such as library materials against theft around the world.

The devices used to activate and deactivate magnetic EAS markers are themselves magnetic. That is, they may include an array of magnets or an electric coil that produces a magnetic field of a desired intensity near a working surface, so that the EAS markers may be passed over that surface to selectively activate or deactivate the marker. Unfortunately, some devices used to change the status of a dual-status marker have the potential to harm magnetically-recorded media, such as videotapes. That is, magnetically-recorded media can be erased, garbled, or damaged by the presence of a magnetic field. Thus, when magnetically-recorded media are passed over a device to change the status of an EAS marker attached thereto, the device may damage the magnetically-recorded media. In view of the foregoing, it is desirable to provide a device for deactivating dual-status magnetic EAS markers that will not damage magnetically-recorded media such as videotapes.

Conventional activation and deactivation systems may reliably activate or deactivate EAS markers positioned along the spine of a book, for example, because the position and orientation of the marker relative to the magnetic field is generally known. With a compact disc, the EAS marker is likely to be positioned on the disc itself, and accordingly may be at any orientation in the X-Y plane relative to the case in which the disc is contained, and thus relative to the applied magnetic field. For example, when the marker is of the type shown in FIG. 1 of U.S. Pat. No. 5,699,047, which is assigned to the assignee of the present invention, the marker may include two elongated marker elements on a support sheet, such that when the marker elements are affixed to the compact disc, they are symmetrically disposed about the centered circular hole in the compact disc. Because the orientation of the markers in the X-Y plane relative to the case in which the disc is contained is essentially random, the markers can be difficult to reliably activate or deactivate without raising the applied magnetic field to a level at which magnetically-recorded media such as video tapes would be damaged. It would be desirable to provide a device that reliably activates and deactivates such markers, while preserving the ability to reliably activate and deactivate the EAS markers associated with videotapes without damaging those tapes.

SUMMARY OF THE INVENTION

A device is provided according to the present invention for changing the status of a dual-status electronic article surveillance marker. The device comprises a coil for creating a magnetic field in a first direction, and a coil for creating a magnetic field in a second direction that is approximately perpendicular to the first direction. The device may include a housing having a passageway therethrough, such that an article to which the marker is attached is positioned within the passageway so that the marker passes through the passageway in an orientation that is generally in the plane defined by the first and second directions. The device may apply the magnetic fields in the first and second directions sequentially or simultaneously, and may even include a coil for creating a magnetic field in a third direction that is substantially perpendicular to the plane defined by the first and second directions. These and other aspects of this invention are described in more detail below.

BRIEF DESCRIPTION OF THE DRAWINGS

The present invention will be described with reference to the attached Figures, in which.

DETAILED DESCRIPTION OF THE INVENTION

Figure 1:
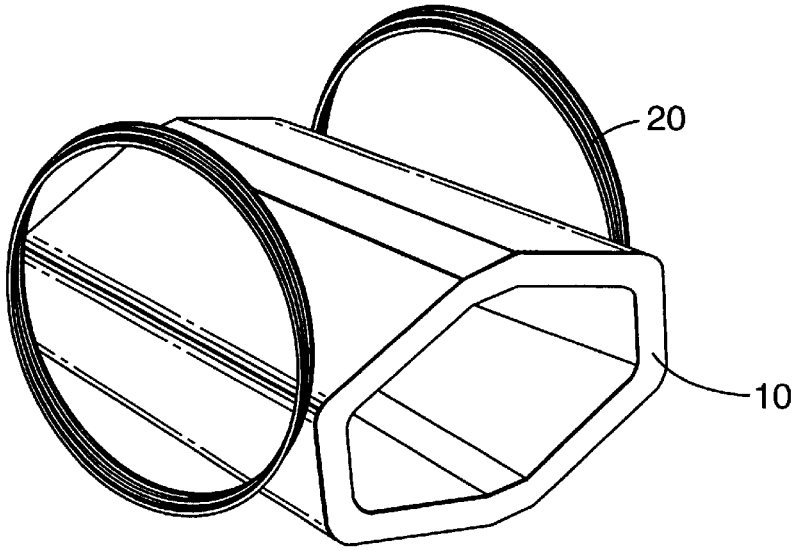
FIG. 1 illustrates a solenoid-type coil and a Helmholtz coil in combination according to the present invention.

One embodiment of the device of the present invention reliably activates and deactivates dual-status magnetic EAS markers using a substantially uniform magnetic field provided in a first direction (such as in the X-direction), for example in the manner described in the co-assigned U.S. patent application incorporated by reference above, and another substantially uniform magnetic field provided in a second direction (such as in the Y-direction) that is generally orthogonal to the first direction. In one embodiment, the first substantially uniform magnetic field is preferably created by a solenoid-type coil, and the second by a Helmholtz-type coil, or modified Helmholtz-type coil, though any appropriate coils that provide similar effects may be used.

A solenoid is normally a cylindrical coil having a passageway therethrough, and a solenoid-type coil, as that term is used in regard to the present invention, is a coil that has a passageway therethrough although its cross-section may not be circular. The cross-section of the housing shown in FIG. 3, for example, is not circular, but can house a solenoid-type coil of the type described herein. A Helmholtz coil is actually a pair of coils having the same radius separated along a common central axis by a distance. The coil separation distance is preferably equal to the radius of the coils. A modified Helmholtz coil, as described below, may be one that is modified by wrapping a pair of coils around one or more layers of the solenoid-type coil, to provide a lower overall profile than if a standard Helmholtz coil were used. This is described in more detail below.

Using these types of coils, or others with the same effect, the intensity of the magnetic fields created, for example, in the X and Y directions sequentially can be maintained throughout a volume of interest at an intensity above that needed to reliably activate or deactivate an EAS marker, but below that at which magnetically-recorded videotape, for example, is damaged. Furthermore, by positioning coils of this type at an appropriate orientation with respect to each other, EAS markers associated with compact discs and other optically-recorded media can be reliably activated and deactivated regardless of their orientation relative to the fields produced by the coils. As a result, magnetically-recorded media such as videotapes to which the EAS marker is attached may be protected by such markers without concern for damage to the media. Another important benefit is that the videotape may remain in the protective case in which it is stored, which saves considerable time for users who have to check many such items out to or in from patrons, or both. These and other benefits will be described in more detail below.

To simplify the description of the present invention, magnetic EAS markers will be described in Section I below, characteristics of magnetic fields used to change the status of such markers in accordance with the present invention will be described in Section II, various embodiments of devices for changing the status of such markers in accordance with the present invention will be described in Section III, and representative circuits will be described in Section IV.

I. Magnetic EAS Markers

Any suitable magnetic EAS marker may be used in conjunction with the device of the present invention, such as those available from the Minnesota Mining and Manufacturing Company of St. Paul, Minn. (3M) under the designation "TATTLE-TAPE." These can include EAS markers for books (designated by 3M as B1, B2, or R2, for example), videotapes (designated by 3M as DVM-1), or CDs (designated by 3M as DCD-2). These magnetic EAS markers include a signal producing layer and a signal-blocking layer. As is well known in the art, when the signal-blocking layer is activated, it effectively prevents detection of signals created by the signal-producing layer. When the signal-blocking layer is deactivated, the signal-producing layer when subjected to the interrogating magnetic field can be detected by a suitable detection system.

The signal producing layer for EAS markers for CD's, such as the DCD-2, is about 7.7 cm (3 in) long, 1 mm (0.04 in) wide, and 180 micrometers (0.007 in) thick, and is made from an amorphous magnetic alloy consisting of about 67% (atomic percent) cobalt, 5% iron, 25% boron and silicon, which is presently commercially available from Honeywell (formerly AlliedSignal) Corporation of Parsippany, N.J. under the designation 2705 M. The signal producing layer element was annealed to reduce the coercivity and to enhance anisotropy in the cross web direction. The signal producing layer for EAS markers for videotapes, such as the DVM-1, is about 13.6 cm (5.375 in) long, 3.18 mm (0.125 in) wide and 180 micrometers (0.007 in) thick, and is made from an iron/nickel composition of the type presently available from Carpenter Technology Corporation of Reading, Pa. under the designation PERMALLOY™.

The signal-blocking layer of the EAS markers described above includes a plurality of spaced segments. For EAS markers such as the DCD-2, each segment is approximately 5 mm (0.20 in) long, 1 mm (0.04 in) wide and 40 micrometers (0.0016 in) thick, and for the DVM-1 marker, each segment is approximately 5 mm (0.2 in) long, 3 mm (0.125 in) wide and 40 micrometers (0.0016 in) thick. The signal-blocking layer is made from an alloy of iron and chromium that is presently commercially available from Arnold Engineering of Marengo, Ill. under the designation Arnokrome 3. In one embodiment, the signal blocking layer segments were annealed to provide a uniform coercivity of about 200+/−30 Oersteds. As described above, the signal-blocking layer is typically provided in discrete pieces at intervals along the length of the signal-producing layer, though other arrangements including contiguous signal blocking layers are suitable as well.

II. Characteristics of the Magnetic Field Associated with the Device of the Present Invention As noted above, an important feature of the device of the present invention is its ability to produce magnetic fields that reliably activate and deactivate magnetic EAS markers, and particularly those markers that may be positioned at any orientation within approximately, for example, the X-Y plane with respect to the magnetic fields, and yet do not damage magnetically-recorded media such as videotape.

A. Changing the Status of the EAS Marker

The EAS marker of the type described above is normally activated by deactivating the signal-blocking layer. That step can be achieved by, for example, exposing the marker to an initial magnetic field in one preferred direction of at least approximately 275 Gauss and then alternating and decreasing the magnetic field in steps of about 15% per each incremental decrease until the magnetic field is below the coercivity range of the signal blocking layer. This is described in, for example, U.S. Pat. No. 6,002,335 (Zarembo et al.), particularly in regard to FIGS. 3 and 4 thereof To deactivate the EAS marker, the signal-blocking layer is activated by, for example, exposing the marker once to a single magnetic field having an intensity of at least approximately 275 Gauss. As such, whereas deactivation of the signal blocking layer involves exposure of the layer to a magnetic field that alternates and decreases in intensity, (which is referred to as "ringing down" the field), activation of the signal blocking layer only requires that the layer be exposed to a half wave of a magnetic pulse that is at least 275 Gauss in intensity.

B. Prevention of Damage to Magnetically-Recorded Media

The characteristics of magnetically-recorded media are different between different types of such media, and will likely change over time. Current standard VHS videotapes and videotapes such as those used in handheld consumer video cameras can generally be exposed to a magnetic field of up to approximately 590 Gauss without being damaged in a manner that is perceptible to most observers. Further, repeated exposure of current videotapes to magnetic fields of less than approximately 560 Gauss typically does not result in discernable damage to the tape.

C. Substantially Uniform Magnetic Field

The magnetic field produced by the device of the present invention should be substantially uniform. The term "substantially uniform," as used in regard to this invention, means that the field within an area of interest (defined below) is always less intense than the level at which magnetically-recorded media such as videotape is damaged, but is always more intense than the level at which the magnetic EAS marker is reliably activated or deactivated. For example, if magnetically-recorded media is damaged when exposed to magnetic fields of 560 Gauss or more, and if magnetic EAS markers are reliably activated or deactivated when exposed to magnetic fields of at least 275 Gauss, then a "substantially uniform" field within the meaning of the present invention is a field that within the zone of interest is between 275 and 560 Gauss. That is, substantially uniform is defined by the boundaries set by the intensity level at which the magnetic media can be damaged (the upper end of the range) and the intensity level at which the magnetic EAS marker can be reliably activated or deactivated (the lower end of the range). The substantially uniform field of the present invention may also be substantially uniform in the conventional sense (meaning that its intensity would be approximately the same at all locations), but conventional uniformity of field intensity is very difficult to achieve in practice, particularly near the ends of a magnetic coil, and is not a requirement of the present invention.

The zone of interest is defined as the area or volume that includes both the magnetically-recorded media and the magnetic EAS marker. If a field is substantially uniform within a zone of interest, then magnetically-recorded media can generally be passed through that magnetic field either within or without their storage cases and yet have the associated magnetic EAS markers be reliably activated or deactivated. Because the size of the storage case, including the position in which the magnetically-recorded media is carried within the storage case, can vary, field uniformity can be very important. Also, as mentioned above, a solenoid-type coil used in conjunction with a Helmholtz type coil can create substantially uniform magnetic fields sequentially perpendicular to each other throughout the volume of a device, thus allowing activation and deactivation of an EAS marker regardless of the orientation of the marker in approximately the X-Y plane without exposing the magnetically-recorded tape to a magnetic field that could cause damage to the tape.

III. Devices for Changing the Status of EAS Markers

Figure 2:
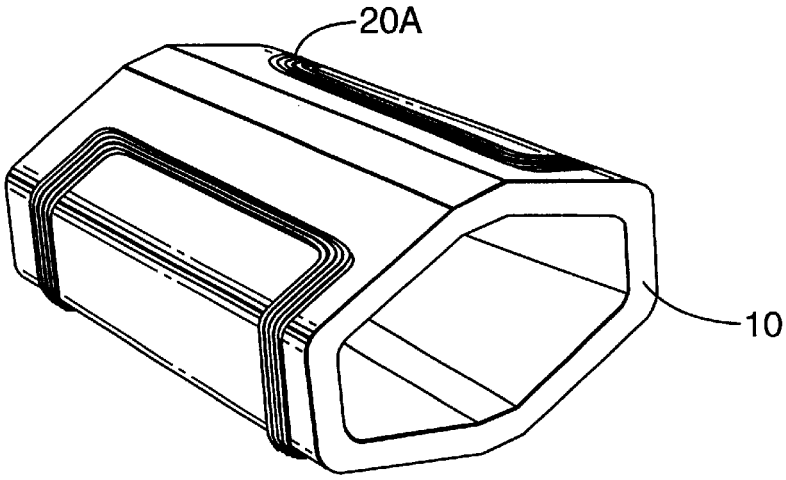
FIG. 2 is a second embodiment of a solenoid type coil and a Helmholtz-type coil in combination according to the present invention.

FIG. 1 illustrates a solenoid-type coil in combination with a Helmholtz coil. The solenoid-type coil 10 creates a magnetic field along the longitudinal axis of the coil in accordance with the principles described in the '238 application. When an EAS marker is parallel to that field, it can be reliably activated and deactivated with a relatively small magnetic field. However, if the EAS marker is perpendicular to the field, then a much larger field is required. To overcome that difficulty, a field in a generally perpendicular direction is created, preferably by a Helmholtz coil 20, or device that performs a similar function. A true Helmholtz coil may be positioned with each of the two coils positioned adjacent the solenoid-type coil, as shown in FIG. 1, but the overall size of the device may be unduly large. In another embodiment of the present invention, the Helmholtz coil is modified by conforming it to the solenoid-type coil, to provide a modified Helmholtz coil 20A, as shown in FIG. 2. This reduces the overall size of the device, with little apparent sacrifice in performance. The Helmholtz-type coil thus produces a magnetic field in a direction generally perpendicular to the field created by the solenoid-type coil. Those fields are normally created sequentially, but could be created substantially simultaneously. In one embodiment, if the signal driving one coil is ninety degrees out of phase with respect to the signal driving the second coil, then a magnetic field of substantially uniform magnitude would be generated rotating about the X-Y plane. When an article to which an EAS marker is attached is passed through the two fields, it is generally in the plane of the directions associated with the two fields and thus can be reliably activated and deactivated. That is, the relative orientation of the article is preferably guided or constrained so that the EAS marker is generally in the plane of the fields established by the coils.

The arrangement shown in FIGS. 1 and 2 and described above has several benefits. When only a solenoid-type coil is used to create the magnetic field used to activate and deactivate EAS markers, the power supplied to that coil is relatively large, so that the coil can activate and deactivate EAS markers that are perpendicular to the field. With the "dual-field" device described above, the power supplied to each coil can be reduced. This leads to another benefit, which is that the wire used to make the coils can be of a smaller size, which further reduces size, weight, and cost. For example, while a solenoid-type coil alone might have required a field of 620 Gauss to change the status of an EAS marker, the fields for the solenoid-type and Helmholtz coils (or their functional equivalents) may be reduced to less than 300 Gauss each.

Figure 3:
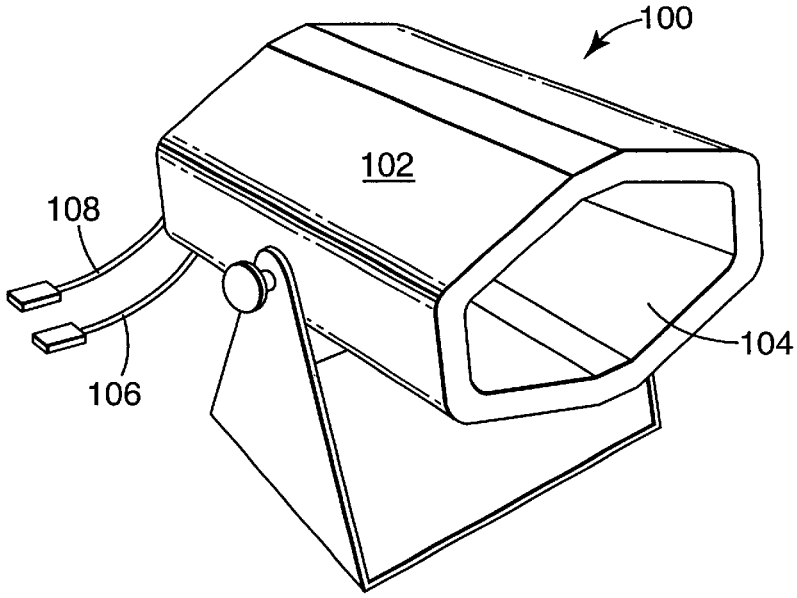
FIG. 3 is an embodiment of a device for activating and deactivating EAS markers according to the present invention.

In another embodiment of the device of the present invention, the modified-Helmholtz coil is provided between two layers of windings of a solenoid-type coil. This arrangement may provide a further reduction in the overall size of the device, and may be aesthetically pleasing as well. When the modified-Helmholtz coil is wrapped around the solenoid-type coil, or provided between two layers of the windings of a solenoid-type coil, or even provided inside the solenoid-type coil, then the device may resemble the one illustrated in the '248 application incorporated above. As shown in FIG. 3, the device includes a body 102 and a passageway 104 therethrough, and can be inclined so that an object inserted in one end of the passageway will move downward and exit the other end of the passageway. In another embodiment, the passageway is closed at one end, so that the videotape or other object is simply inserted into and removed from the same end of the passageway. Variations on the physical design of the device 100 are certainly possible, and can include designs in which the passageway is generally horizontal (perhaps with some conveyer, a driving mechanism, or other device to move the object through the passageway), for example. Device 100 typically also includes a power connection 106 and, if all of the control circuitry is not contained within the housing, connecting circuitry 108.

Figure 4:
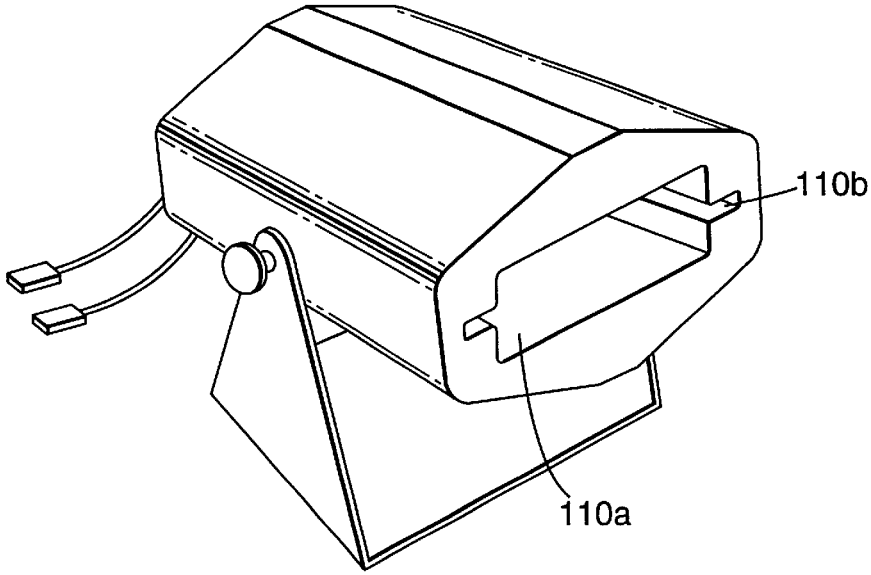
FIG. 4 is a second embodiment of a device for activating and deactivating EAS markers according to the present invention.

The opening of the passageway could instead be designed as shown in FIG. 4 so that only objects having a known profile would fit into the passageway. The opening or passageway 110*a* shown in FIG. 4 is dimensioned to receive cased videotapes in a known orientation, and opening or passageway 110*b* is dimensioned to receive cased optical or compact discs in a known orientation.

IV. Circuit Diagrams

Figure 5:
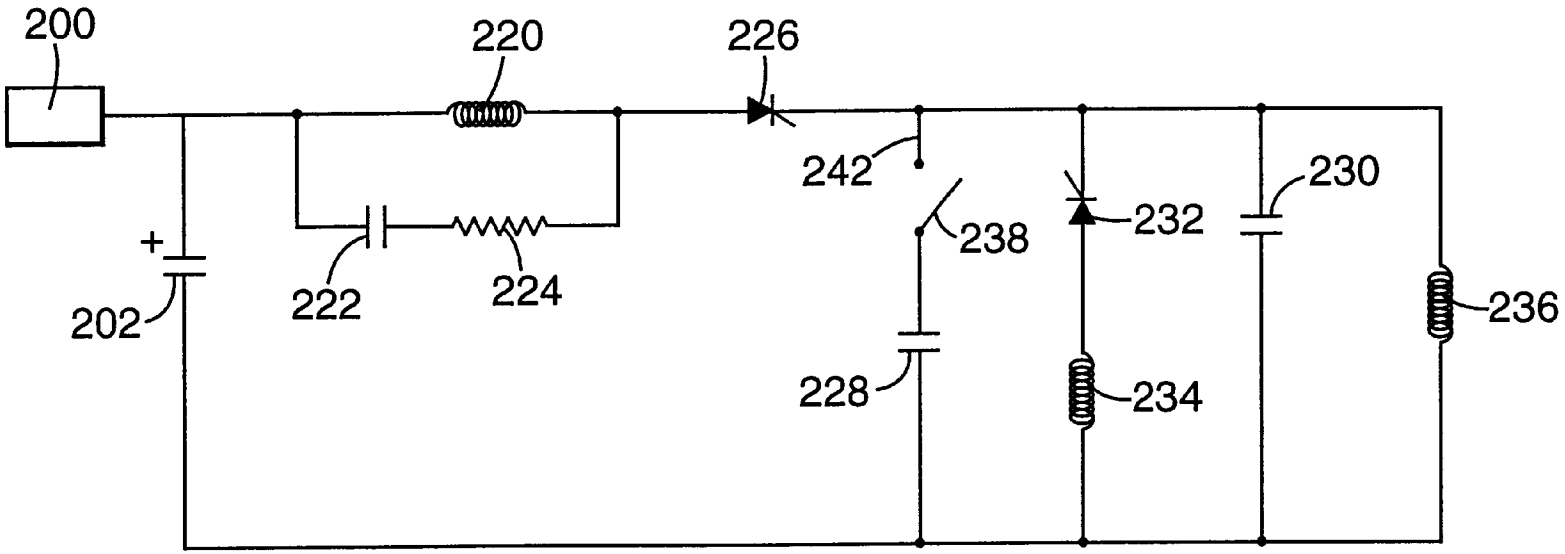
FIG. 5 is a representative circuit diagram of a drive circuit for use with the device of the present invention.
Figure 6:
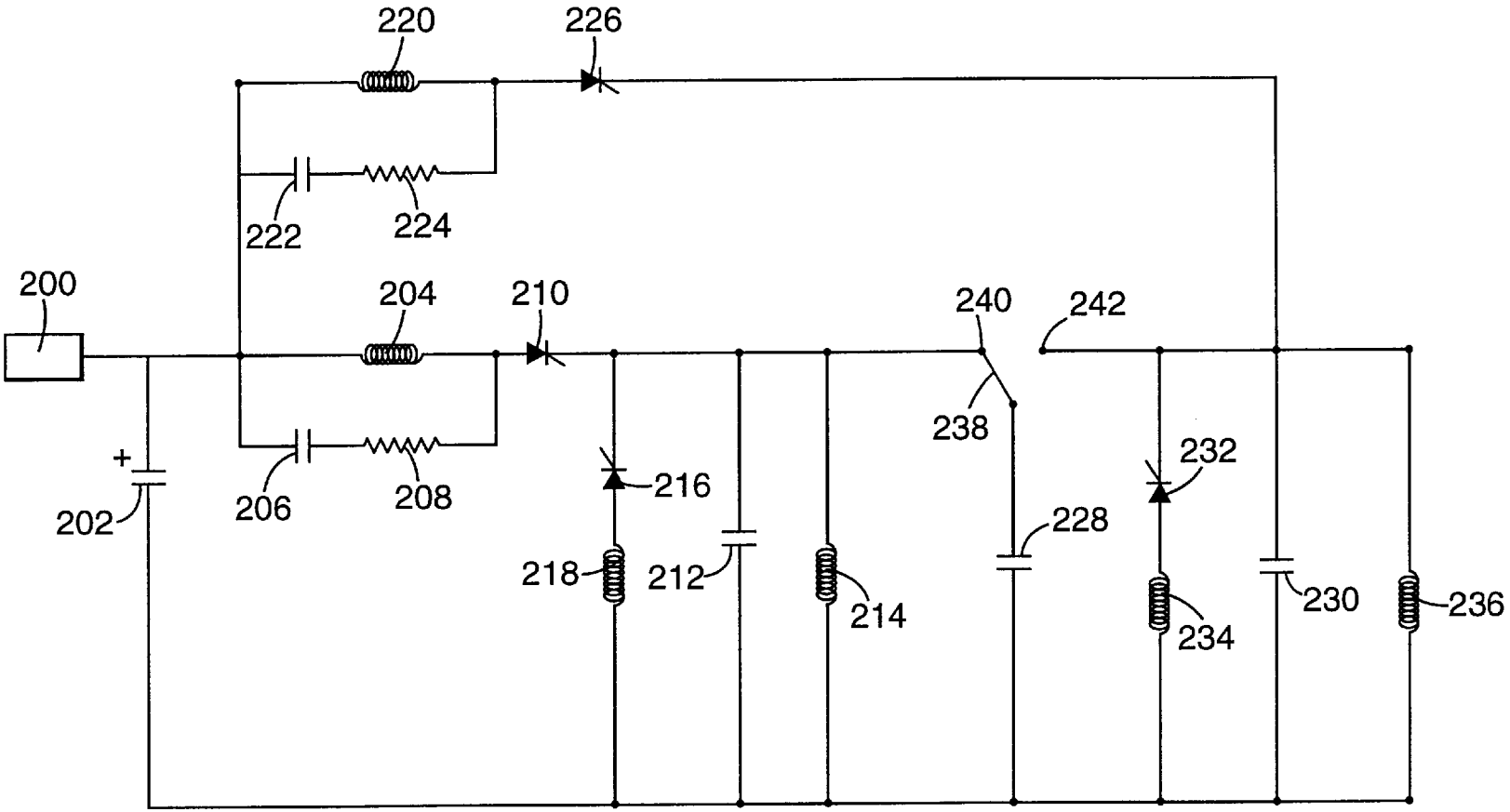
FIG. 6 is a second representative circuit diagram of a drive circuit for use with the device of the present invention.

The circuit diagrams shown in FIGS. 5 and 6 illustrates representative control circuits, which although they may produce fields of different intensities for various purposes, may also produce fields of substantially the same intensity for driving the coils described above. Another drive circuit that may be used in conjunction with the present invention is disclosed in copending U.S. patent application Ser. No. 09/880,486 filed Jun. 13, 2001 and entitled "Field Creation in a Magnetic Electronic Article Surveillance System," the entire contents of which is incorporated by reference herein.

As shown in FIG. 5, the device may be powered by a power source 200, which is preferably direct current (DC), that is paired with a capacitor 202 to provide a uniform power output to the remainder of the control circuit. Power is provided to inductor 220, which is connected in parallel to capacitor 222 and resistor 224. This LRC circuit prevents silicon control rectifier (SCR) 226 from turning on shortly after it is turned off, as described below. The power source charges capacitor 230 to the appropriate voltage, and when the current in the circuit reaches zero, SCR 226 turns off and inductor 236 rings down, preferably over a relatively long period of time. That period of time depends on the characteristics of the circuit, including the Q value of the circuit (defined as the ratio of the reactive impedance to the resistance in the circuit). When the inductor 236 rings down over a relatively long period of time, preferably within an exponential envelope exhibiting a constant percentage decrease between adjacent positive peaks of between 30–38%, then the signal blocking layer associated with a conventional EAS marker can be reliably deactivated. When activating the signal-blocking layer, ring down is stopped at the completion of one half of a sine wave (one positive peak), and the remainder of the current is bled off to ground by SCR 232 and inductor 234. Ring down is stopped at the completion of one half of a sine wave by SCR 232 and inductor 234 preventing the current in the circuit from going negative. By preventing the current from going negative, the circuit will switch, thus keeping the magnetic field from going above the absolute value of the coercivity of the markers in the opposite direction. The circuit of FIG. 5 further includes capacitor 228 that selectively connects to the remainder of the circuit via switch 238.

The circuit of FIG. 5 could be used, for example, within or in conjunction with the device shown in FIGS. 1 through 4 to activate and deactivate EAS markers on videotapes or compact discs. Switch 238 can either be open (such as shown in FIG. 5) or contacting pole 242, as controlled, preferably, by an appropriate computer control system. When switch 238 is in the open position, the circuit can be used to activate and deactivate markers on a videotape, and when switch 238 is closed to contact pole 242, thereby adding additional capacitance to the circuit, the circuit can be used to activate and deactivate markers on compact discs.

For certain EAS markers used to mark compact discs, such as those described in U.S. Pat. Nos. 5,825,292 and 5,699,047 (Tsai et al.), the combined capacitance of capacitors 228 and 230 is set to, for example, 68 microFarads, to insure that the marker is reliably activated and deactivated no matter what position it is in relative to the applied field. This can be achieved, in one exemplary embodiment, by having the capacitance of capacitors 228 and 230 to be 60 microFarads and 8 microFarads, respectively. The field required to reliably activate and deactivate markers placed on videotapes can be much lower than that used for books and compact discs if the orientation of the EAS marker is generally known. For example, where the EAS marker is oriented parallel to the length of the device, a capacitor 230 having a capacitance of 8 microFarads may produce a field sufficient to activate and deactivate the EAS marker reliably without damaging the videotapes.

FIG. 6 is another exemplary circuit diagram of a control circuit that can be used to activate and deactivate the EAS markers associated with various items using fields of different intensity, and incorporates aspects of the circuit shown in FIG. 5. That is, the control circuit shown in FIG. 6 can be used to activate and deactivate EAS markers on videotapes as described above, but can also activate and deactivate EAS markers on books and compact discs. If a housing is used to contain a coil such as the solenoid-type coils described herein, the opening for the housing should be sufficiently large to enable various types of materials to pass into the housing.

As shown in FIG. 6, switch 238 can contact either or neither of poles 240 or 242, as determined, preferably, by an appropriate computer control system. If switch 238 doesn't contact either of poles 240 or 242, then the circuit operates in the manner described above and can be used to deactivate EAS markers on books or videotapes, dependant upon whether SCR 210 or 226 is activated, respectively. If, as shown in FIG. 6, switch 238 contacts pole 240, then capacitor 228 is connected into the circuit and adds its capacitance thereto. If the capacitance of capacitor 228 is, for example, 60 microFarads, then the combined capacitance of the circuit is increased from 60 to 120 microFarads. Upon activation of SCR 210, inductor 214 is then caused to create a field that enables activation and deactivation of EAS markers associated with either books or compact discs.

Referring still to the circuit in FIG. 6, if switch 238 contacts pole 242, then capacitor 228 is switched into a circuit such as shown in FIG. 3, and similarly adds its capacitance thereto. If the capacitance of capacitor 230 is, for example, 8 microfarads (and assuming the capacitance of capacitor 228 is 60 microfarads, as stated above), then the combined capacitance of the circuit is increased from 8 to 68 microfarads. Upon activation of SCR 226, inductor 236, which can have an inductance of, for example, 3.15 milliHenries, is then caused to create a field that enables the device to activate and deactivate EAS markers associated with, for example, CDs.

The following table provides circuit elements (and their characteristics) that may be used in the above-mentioned exemplary circuits.

TABLE 1

| | |
|---|---|
| Power source 200: | 420 volts DC |
| Capacitor 202: | 4600 microFarads |
| Inductor 204: | 40 microHenries |
| Capacitor 206: | 0.22 microFarads |
| Resistor 208: | 47 ohms |
| Resistor 224: | 47 ohms |
| Capacitor 212: | 60 microFarads |
| Inductor 214: | 800 microHenries |
| Inductor 218: | 10 microHenries |
| Inductor 220 | 40 microHenries |
| Capacitor 222 | 0.22 microFarads |
| Capacitor 228 | 60 microFarads |
| Capacitor 230 | 8 microFarads |
| Inductor 236 | 3150 microHenries |
| Inductor 234 | 10 microHenries |

The SCRs of the type described above are currently available from International Rectifier, El Segundo, Calif. under the designation 25R1A120. These and other suitable control circuits and components may be used to operate the device of the present invention.

Inductor 236 can be provided in the form of a coil that acts, as described above, as a solenoid-type coil for activating and deactivating the EAS markers associated with items of interest. Coil 236 (because it would be used for videotapes) is preferably either round or generally round, because these shapes provide the most uniform field characteristics. The coil should also be designed to be as small as possible and yet still be able to accommodate the items of interest, because larger coils have greater resistance, require more power to operate, and reduce the Q value of the circuit. The devices shown in FIGS. 3 and 4, for example, could each include a coil inside, typically having multiple turns of metal wire that are generally concentrically arranged with respect to a central passageway or opening. In one embodiment, coil 236 is made of 14 gauge pure copper wire having a square cross-sectional profile (to provide more turns per unit of length along the coil), and includes 147 turns, and an inductance of 1.52 mH. A coil of this type is available from Mag-Con Engineering Inc. of Lino Lakes, Minn. under the designation number MC7424A. The modified Helmholtz coil may be made of 13 gauge pure copper wire having a circular cross-sectional profile, and may have 40 turns (2 layers of 20 turns each), and an inductance of 1.62 mH. A coil of this type is available from Mag-Con Engineering Inc. under the designation MC7579.

The present invention is described largely in terms of a solenoid as a first coil and a Helmholtz coil as a second coil, though that is simply one useful embodiment because the solenoid is easy to make, and provides a form or base for the Helmholtz coil. It is also possible to use two Helmholtz coils or, though constructing a working embodiment may be difficult, two solenoid coils, or other coils that perform in a similar manner.

V. Other Components and Features

The device of the present invention may also include one or more detection systems for determining when something is entering the device, or for determining what that object is, or both. For example, photo-detectors may be used, such that when an object entering the passageway interrupts a beam of visible or invisible light, a signal is generated that is indicative of the presence of an object. These types of sensors are well known in the art. More than one such sensor may be provided, so that a first sensor activates a detector that determines the type of item present, and if the item is one that will not be damaged by the device, a second sensor activates the circuitry to activate or deactivate the EAS marker associated with the item.

The detection system may include an RFID interrogator that interrogates and thereby obtains information from RFID tags associated with items used with the device. The RFID detection system typically includes a loop antenna and an antenna tuning circuit that matches the impedance of the antenna to the impedance of the RFID circuitry. The antenna and antenna tuning circuit are connected to the RFID interrogator. The RFID interrogator may be triggered by a signal produced by a photo-detector, or by any other suitable means including a manually activated switch. When the RFID interrogator interrogates the RFID tag, the tag responds with information that the interrogator or another system can use to determine the type of object to which the tag is attached.

The device of the present invention preferably creates magnetic fields in two essentially perpendicular directions, so that EAS markers that are approximately in the plane of those two directions may be reliably activated and deactivated. If, for example, an EAS marker is inclined at an angle greater than about 45 degrees with respect to that plane, then reliable activation and deactivation is more difficult to obtain. This can be addressed in one or more ways. A simple way is to structure an opening or passageway through the device so that the EAS marker remains in approximately the X-Y plane. It may also be possible to provide a third coil or other field-generating device that creates a magnetic field in the third dimension, so that even if an EAS marker is inclined with respect to, for example, an X-Y plane, a field directed along the Z plane will reliably activate and deactivate the marker without harming magnetically recorded media, such as videotapes. These fields are normally created or applied sequentially. Thus the present invention should be understood to include devices that produce fields in both two and three substantially mutually orthogonal directions, for the reasons described above, and a passageway that restricts an article to only a particular plane is preferred, but not required.

Another optional feature of the present invention is related to a solution to the following problem. In some instances, it is possible that an EAS marker that is active can be deactivated by a first applied field, but then activated (reactivated) by the second applied field, which is undesirable because the user would expect that the EAS marker is inactive when it is not. (The reverse situation—an EAS marker that is inactive being activated by a first field and deactivated by the second field—is less likely to occur.) Without wishing to be bound by any particular technical theory, it is believed that the potential problem may arise when the EAS marker is subjected to a first field and then subjected to a second field that is perpendicular to the first field, and when the long axis of the EAS marker is parallel to the plane of the two fields. If the vector component of the second field is opposite to the main vector of the first field, and also equal to approximately ½ of the coercivity of the marker, a condition can occur where half of the magnetic domains of the keepers are oriented in one direction and half in the other direction such that the net vector sum is zero. The result is believed to be that the keepers are once again in a demagnetized state, and the EAS marker reactivated. This condition may occur when the major component of direction of the marker is in only the first field direction. This problem is likely to occur only rarely.

The optional feature of the invention that relates to this problem is to verify the status of the marker after it has been subjected to the second field. If the marker is supposed to have been deactivated but is active, then the first field can be activated again to deactivate the marker. The status of the marker may be verified by driving the current in the first coil a manner sufficient to produce an AC or decaying AC magnetic field sufficient to cause the marker to switch so that it may be detected in a known manner. In short, a magnetic field would be applied of the type normally used to detect the marker while in use, and a detection system would be used to determine whether the marker is active. Then if the marker is active but is supposed to be inactive, the first field can be applied again to deactivate the marker.

VI. Summary

The device of the present invention is particularly useful for library applications, because it speeds the process of checking library materials into and out of a library by eliminating the need to remove videotapes from their cases. Retail video rental establishments that currently use single-status EAS markers (EAS markers that can never be deactivated) may, through the use of the device of the present invention, instead use dual-status EAS markers with confidence that their inventory of videotapes will not be damaged when the EAS marker is activated or deactivated. This would also eliminate another common problem—the activation of detection systems in other establishments (such as libraries or stores) by the single-status EAS markers attached to videotapes from the video rental establishment.

Yet another benefit is the ability of the device of the present invention to reliably activate and deactivate markers that can be difficult to activate and deactivate when they are presented in certain orientations relative to conventional activation/deactivation devices. For example, EAS markers attached to compact discs may encounter an activation/deactivation device at a wide variety or orientations depending on how the disc is oriented within the case.

These and other benefits of the present invention will be appreciated by persons of skill in the art, as will certain variations of the embodiments described herein. Accordingly, the invention is limited not by those embodiments, but by the claims set forth below.

We claim:

1. A device for changing the status of a dual-status electronic article surveillance marker, the device comprising:

(a) a coil for creating magnetic field in first direction; and (b) a coil for creating a magnetic field in a second direction that is approximately perpendicular to the first direction; and (c) a housing having a passageway therethrough, such that an article to which the marker is attached is positioned within the passageway so that the marker passes through the passageway in an orientation that is generally in the plane defined by the first and second directions;

wherein the first coil is a solenoid-type coil, and the second coil is a modified Helmholtz coil that conforms to the shape of the solenoid-type coil.

2. The device of claim 1, wherein at least one of the coils is a solenoid-type coil.

3. The device of claim 1, wherein at least one of the coils is a Helmholtz coil.

4. The device of claim 1, wherein the coils each create a magnetic field with an intensity of between 275 Gauss and 560 Gauss.

5. The device of claim 1, wherein:

said housing contains the coils and defines the passageway extending through the coils.

6. The device of claim 5, wherein the passageway has a cross-sectional opening shaped to receive an optical disc within a case.

7. The device of claim 5, wherein the passageway has a cross-sectional opening shaped to receive a cased videotape.

8. The device of claim 1, further comprising a detection system for detecting the presence of the article.

9. The device of claim 8, wherein the detection system is an optical detection system.

10. The device of claim 8, wherein the detection system is an RFID interrogator that obtains information from an RFID tag associated with the article.

11. The device of claim 1, in combination with an optical disc.

12. The device of claim 1, wherein the device includes a third coil for creating a magnetic field in a third direction that is approximately perpendicular to the plane.

13. The device of claim 1, wherein the device includes a verification system for verifying the status of the marker after the marker has been exposed to magnetic fields in the first and second directions.

14. The device of claim 13, wherein the device is adapted to reapply the magnetic field in the first direction.

15. The device of claim 1, wherein the device is adapted to create the first and second magnetic fields sequentially.

16. The device of claim 1, wherein the device is adapted to create the first and second magnetic fields substantially simultaneously.

* * * * *